US006971434B2

(12) United States Patent
Nien

(10) Patent No.: US 6,971,434 B2
(45) Date of Patent: Dec. 6, 2005

(54) NON-PULL CORD OPERATED VENETIAN BLIND

(76) Inventor: Leslie Nien, No. 45-4, Fan Po St., Fu Hsing Hsiang, Changhua Hsien (TW)

( * ) Notice: Subject to any disclaimer, the term of this patent is extended or adjusted under 35 U.S.C. 154(b) by 0 days.

(21) Appl. No.: 10/739,065

(22) Filed: Dec. 19, 2003

(65) Prior Publication Data

US 2005/0082019 A1 Apr. 21, 2005

(30) Foreign Application Priority Data

Oct. 17, 2003 (CN) ..... 92218491 U

(51) Int. Cl.[7] ..... E06B 9/327

(52) U.S. Cl. ..... 160/172 R; 160/168.1 R; 160/178.2; 24/331; 24/339

(58) Field of Search ..... 160/168.1 R, 172 R, 160/173 R, 84.06, 277, 278, 279, 170, 171; 24/331, 332, 339

(56) References Cited

U.S. PATENT DOCUMENTS 573,138 A * 12/1896 Conner ..... 160/278
765,113 A * 7/1904 Vogel et al. ..... 160/278
4,202,395 A * 5/1980 Heck et al. ..... 160/84.06
5,052,085 A * 10/1991 Gau ..... 24/501
6,443,207 B1 * 9/2002 Cheng et al. ..... 160/84.04
6,681,831 B1 * 1/2004 Cheng et al. ..... 160/84.06
6,684,930 B2 * 2/2004 Palmer et al. ..... 160/170
2005/0092446 A1 * 5/2005 Ni ..... 160/172 R

* cited by examiner

*Primary Examiner*—Blair M. Johnson
(74) *Attorney, Agent, or Firm*—Troxell Law Office, PLLC

(57) ABSTRACT

A non-pull cord operated Venetian blind includes a blind embodiment having left/right retaining cords led through both lateral sides thereof and fixed to a windowsill at the bottom ends thereof, and a pair of clamps securely sealed at both ends of a lower beam to clamp tight the retaining cords thereby. The clamp is made up of a movable plate and a fixed plate with a spring element attached there-between. A serrated retaining section and a serrated fixing section are disposed at the corresponding inner side of the movable plate and the fixed plate thereof respectively, tightly engaged via the spring element for holding the left/right retaining cords therein in clamping location, and a step-wise coupling section is disposed at the outer side of the fixed plate thereon to securely fix the clamps thereof onto both ends of the lower beam thereby. Thus, the clamps are pushed to the compress spring elements adapted therein and detach the retaining cords there-from so that the blind embodiment is easily adjusted up or down along the retaining cords thereof into a proper position before the pressing force is removed to clamp tight the retaining cords via the clamps and precisely relocate the blind embodiment at the proper position, providing a non-pull cord Venetian blind to effectively protect the safety of children in the household. Besides, a pair of clamping devices with push rods can also be adapted to both ends of the lower beam with the same effect thereof.

1 Claim, 4 Drawing Sheets

NON-PULL CORD OPERATED VENETIAN BLIND

BACKGROUND OF THE INVENTION

The present invention is related to a non-pull cord operated Venetian blind, including a blind embodiment having left/right retaining cords led through both lateral sides thereof, and a lower beam with a pair of clamps securely sealed at both ends thereon for the retaining cords to be held thereby before led downwards to be fixed to a windowsill at the bottom ends thereof; whereby, the clamp, made up of a movable plate and a fixed plate with a spring element attached there-between, is pressed inwards to detach the retaining cords from the clamping location of a serrated retaining section and a serrated fixing section of the movable plate and the fixed plate thereof respectively so that the blind embodiment is easily adjusted up or down along the retaining cords before the pressing force is removed to clamp tight the retaining cords via the clamps and precisely relocate the blind embodiment at a proper position, providing a non-pull cord Venetian blind to effectively protect the safety of children in the household.

A conventional Venetian blind is usually made up of a volute wheel unit in cooperation with pull cords and T-shaped cords, which is not only tediously complex in assembly, but also quite dangerous to children in the household. When the Venetian blind is gathered up, pull cords are suspended downwards for a certain length outside the blind thereof. Children playing around the blind may easily get caught by the suspending pull cords. In case the blind is careless unfolded, the withdrawing pull cords might hurt or even strangle the children got caught in them. Thus, the conventional Venetian blind poses a potential danger to children in the household.

SUMMARY OF THE PRESENT INVENTION

It is, therefore, the primary purpose of the present invention to provide a non-pull cord operated Venetian blind, including an blind embodiment having left/right retaining cords led through both lateral sides thereof, and a pair of clamps sealed at both ends of a lower beam for holding the retaining cords therein in clamping location thereby wherein the clamps are pushed to compress spring elements adapted therein and detach the retaining cords there-from so that the blind embodiment is easily moved by the bottom of the lower beam and adjusted up or down along the retaining cords thereof into a proper position before the pressing force applied is removed to clamp tight the retaining cords via the clamps and precisely relocate the blind embodiment at the proper position, facilitating an easy and fast operation thereof.

It is, therefore, the secondary purpose of the present invention to provide a non-pull cord operated Venetian blind wherein the left/right retaining cords securely held by the clamps in clamping location thereby are led straight downwards to be fixed to a windowsill, providing a non-pull cord Venetian blind so that children playing around won't get caught or strangled by them to effectively protect the safety of household.

It is, therefore, the third purpose of the present invention to provide a non-pull cord operated Venetian blind wherein, via two clamps adapted at both ends of the lower beam to hold the retaining cords therein, the blind embodiment is easily and precisely gathered up or unfolded without any other volute wheel unit, pull cords, or T-shaped cords applied thereon, economically reducing the parts of assembly as well as the costs of materials, and effectively boosting the competitive power of the present invention in the market.

DETAILED DESCRIPTION OF THE PREFERRED EMBODIMENTS

Figure 1:
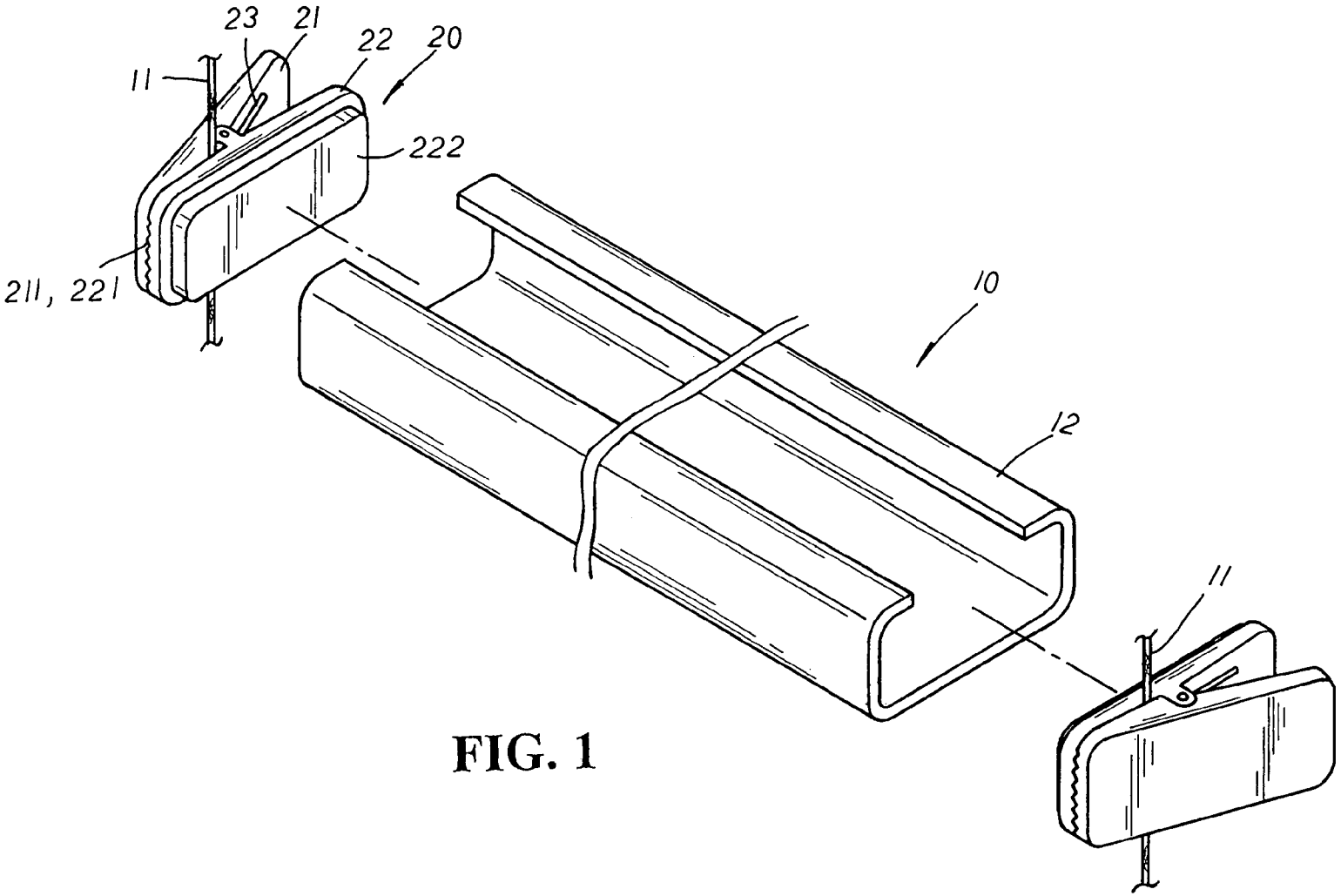
FIG. 1 is a perspective exploded view of the present invention.
Figure 3:
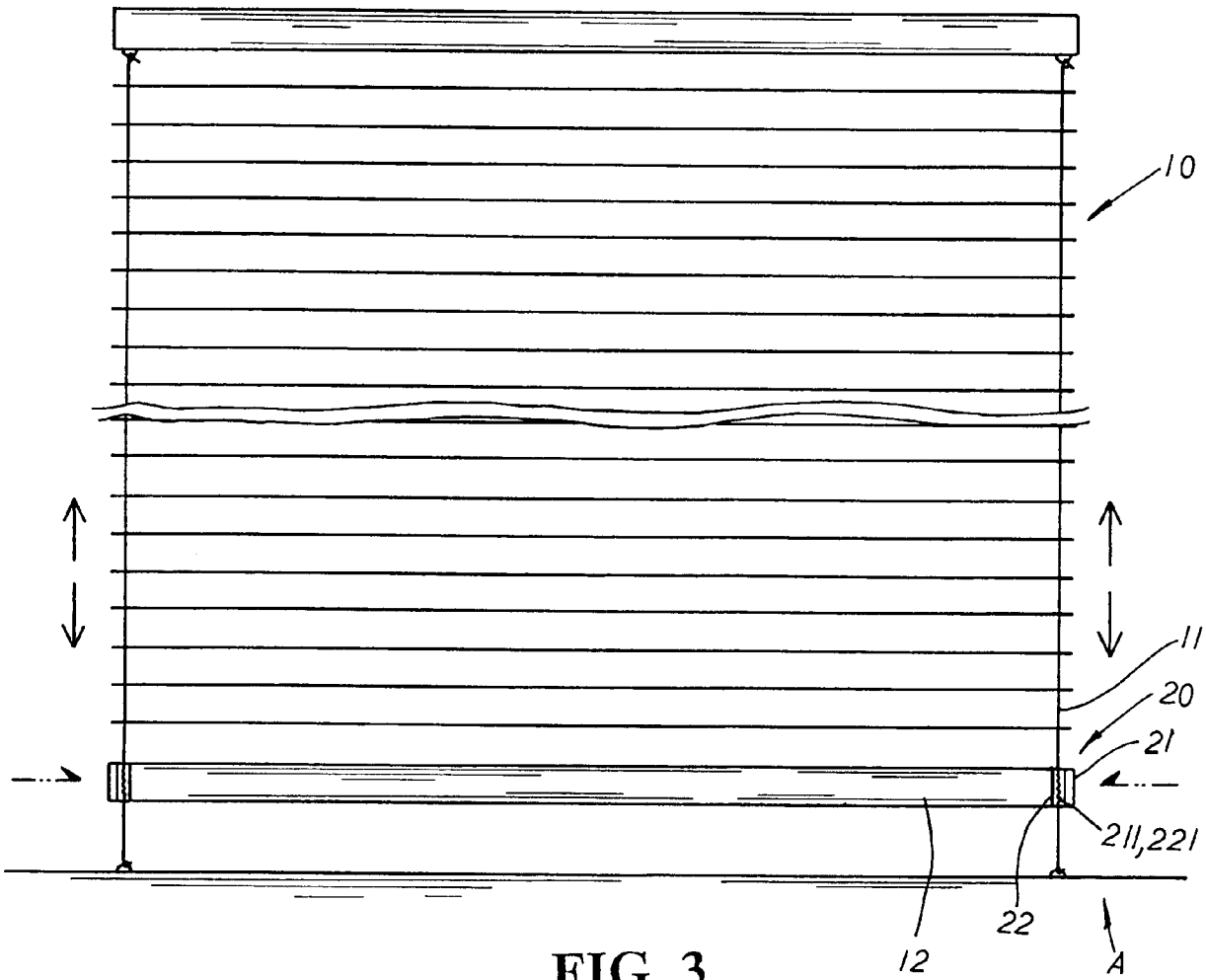
FIG. 3 is a diagram showing a blind embodiment of the present invention pushed upwards or drawn downwards in practical use.

Please refer to FIG. 1. The present invention is related to a non-pull cord operated Venetian blind, comprising a blind embodiment 10, left/right retaining cords 11 led through both lateral sides of the blind embodiment 10 to be fixed to a windowsill A at the bottom ends thereof as shown in FIG. 3, a lower beam 12 attached at the bottom of the blind embodiment 10, and two clamps 20 adapted at both ends of the lower beam 12 therein. The clamp 20 is made up of a movable plate 21 and a fixed plate 22 at both lateral sides thereof with a spring element 23 attached at the movable plate 21 and the fixed plate 22 there-between. A serrated retaining section 211 and a serrated fixing section 221 are disposed at the corresponding inner side of the movable plate 21 and the fixed plate 22 thereof respectively, bound tight in mutual engagement via the spring element 23 for clamping location of the left/right retaining cord 11 therein. The fixed plate 22 of the clamp 20 also has a step-wise coupling section 222 disposed at the outer side thereon to be fixedly joined into both ends of the lower beam 12 respectively for location of the clamp 20 at the lower beam 12 thereby.

Figure 2:
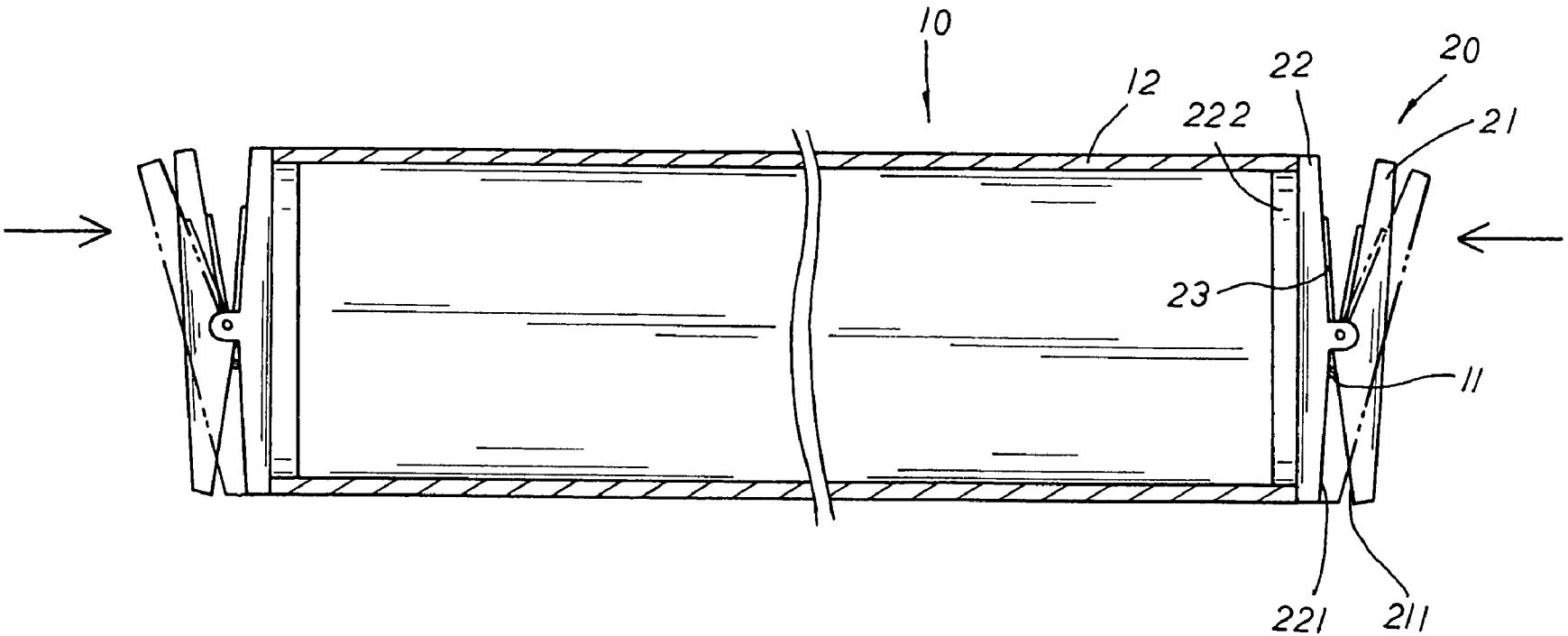
FIG. 2 is a cross sectional top view of the present invention in operation.

Please refer to FIGS. 2 to 3 inclusive. In assembly, the coupling sections 222 of the clamps 20 are adapted into the lower beam 12 from both sides respectively with the fixed plates 22 thereof securely sealed at both ends of the lower beam 12 in abutting location thereon. To adjust the blind embodiment 10 into a proper position, the movable plates 21 of the clamps 20 are pressed inwards to compress the spring element 23 adapted therein and expand open the engaged retaining section 211 and fixing section 221 thereof to detach the left/right retaining cords 11 from the clamping location of the clamps 20 thereof so that the blind embodiment 10 is able to be moved by the bottom side of the lower beam 12 and adjusted upwards or downwards along the left/right retaining cords 11 thereof as shown in FIG. 3. To relocate the blind embodiment 10 at the proper position adjusted, the pressing force applied onto the movable plates 21 thereof is removed to bounce back the compressed spring element 23 and close up the retaining section 211 and the fixing section 221 thereof so as to clamp tight the left/right retaining cords 11 there-between, precisely relocating the blind embodiment 10 at the proper position thereof to achieve the best using condition. Meanwhile, the left/right retaining cords 11 clamped tight by the clamps 20 thereof are led straight downwards to be fixed to a windowsill A at the bottom ends thereof, providing a non-pull cord Venetian blind so that children playing around won't get caught or strangled by them to effectively protect the safety of household.

Figure 4:
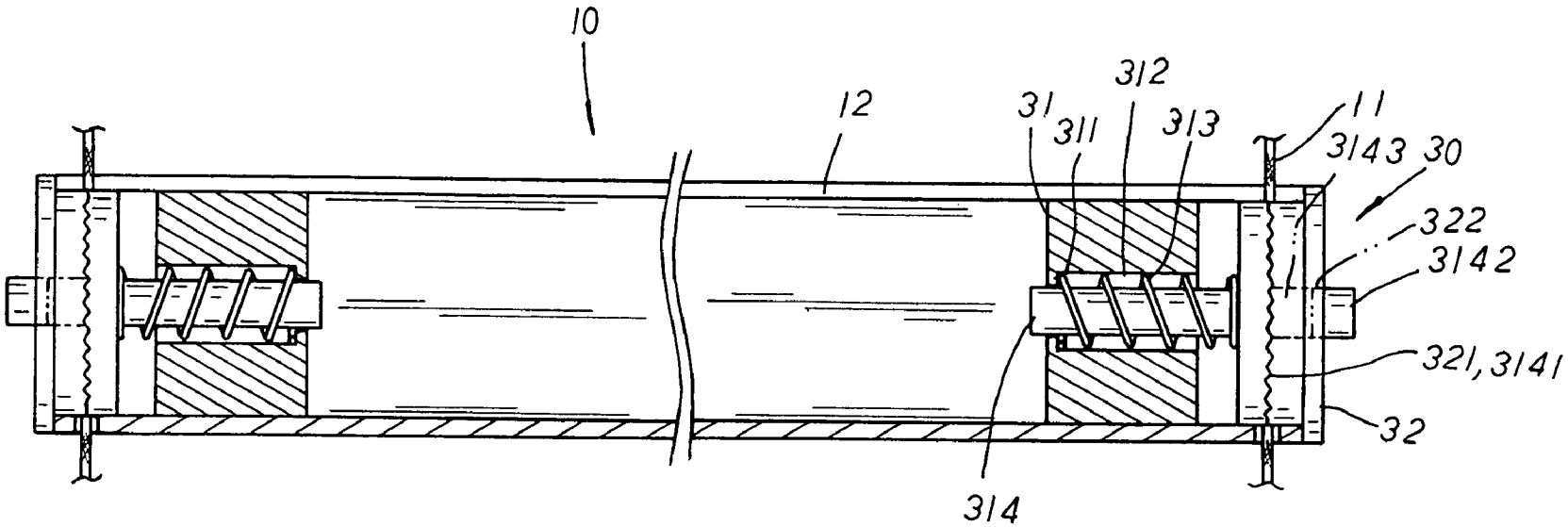
FIG. 4 is a cross sectional view of another embodiment of the present invention.

Please refer to FIG. 4. The present invention can also have a clamping device 30 with a coupling body 31 disposed at one side thereof to be adapted into the inner side of both ends of the lower beam 12 thereof respectively. The other side of the clamping device 30 is provided with a fixed unit 32 having a serrated fixing section 321 disposed thereon to securely locate the clamping device 30 at both ends of the lower beam 12 thereby. The coupling body 31 is made up of a central through hole 312 with a stop flange 311 disposed at the inner side thereof for a movable unit 314 having a spring element 313 disposed thereon to be led there-through and abutted against the stop flange 311 thereby. The movable unit 314 has a serrated retaining section 3141 protruding at one side thereof in clamping engagement with the serrated fixing section 321 of the fixed unit 32 via the spring element 313 thereof. A central passage 322 is disposed at the middle of the serrated fixing section 321 of the fixed unit 32 for a push rod 3142 protruding at the middle of the serrated retaining section 3141 of the movable unit 314 thereon to be extended there-through with a push end exposed outside there-from. A pivoting hole 3143 is properly preset at the push rod 3142 thereon for the retaining cord 11 thereof to be led there-through and held by the serrated retaining section 3141 and the serrated fixing section 321 thereof in clamping location thereby. Thus, to release the left/right retaining cords 11 from the clamping location thereof, the push rod 3142 of the movable unit 314 is pushed inwards, compressing the spring element 313 thereof to detach the retaining cords 11 thereof from the clamping location of the serrated retaining section 3141 and the serrated fixing section 321 thereof so that the blind embodiment 10 is able to be moved by the bottom side of the lower beam 12 and adjusted upwards or downwards along the left/right retaining cords 11 into a proper position. The pressing force applied onto the push rod 3142 is removed to bounce back the spring element 313 and clamp tight the retaining cords 11 at the serrated retaining section 3141 and the serrated fixing section 321. there-between so as to relocate the blind embodiment 10 at the adjusted proper position thereof.

What is claimed is:

1. A non-pull cord operated Venetian blind for a window comprising:

a) a blind;

b) a lower beam connected to a bottom of the blind;

c) left and right pull cords, each of the left and right pull cords is led through one of two opposing sides of the blind and one of two opposing ends of the lower beam, each of the left and right pull cords having an end connected to a windowsill of the window; and d) a pair of clamping devices, each clamping device having:

i) a coupling body (31) located on an interior of the lower beam and having a central through hole (312) with a stop flange (311);

ii) a movable unit (314) movable between engaged and disengaged positions and having a serrated retaining section (3141), a spring (313) located on a first end thereof, and a push rod (3142) located on a second end thereof, the first end of the movable unit is inserted into the central through hole, the spring is located between the serrated retaining section and the stop flange, each push rod having a cord hole (3143), one of the left and right pull cords is inserted through each cord hole; and iii) a fixed unit (32) located on one of the two opposing ends of the lower beam of the lower beam and having a serrated fixing section (321) and a central passage (322) located in a center of the serrated fixing section, the push rod is inserted through and protrudes outwardly from the central passage, wherein the spring is biasing the serrated retaining section towards the serrated fixing section, in the engaged position each of the left and right pull cords is fixed between one serrated retaining section and one serrated fixing section, and in the disengaged position each of the left and right pull cords is slidably located between one serrated retaining section and one serrated fixing section.

* * * * *